US006123501A

United States Patent [19]

Pisco

[11] Patent Number: 6,123,501

[45] Date of Patent: Sep. 26, 2000

[54] WEAR-COMPENSATING UNIVERSAL QUICK COUPLING DEVICE FOR HEAVY EQUIPMENT ATTACHMENT

[75] Inventor: Walter J. Pisco, Woodinville, Wash.

[73] Assignee: Pacific Services & Manufacturing Corp., Woodinville, Wash.

[21] Appl. No.: 09/040,918

[22] Filed: Mar. 18, 1998

[51] Int. Cl.[7] ..... E02F 3/28

[52] U.S. Cl. ..... 414/723; 37/468

[58] Field of Search ..... 414/723; 37/468; 403/321, 322.1, 324

[56] References Cited

U.S. PATENT DOCUMENTS

| | | | |
|---|---|---|---|
| 3,556,323 | 1/1971 | Heimmermann | 214/145 |
| 3,818,551 | 6/1974 | Coughran, Jr. | 24/243 |
| 4,214,840 | 7/1980 | Beales | 414/723 X |
| 4,881,867 | 11/1989 | Essex et al. | 414/723 |
| 4,955,779 | 9/1990 | Knackstedt | 414/723 |
| 4,986,722 | 1/1991 | Kaczmarczyk et al. | 414/723 |
| 5,024,010 | 6/1991 | Hulden | 414/723 X |
| 5,082,389 | 1/1992 | Balemi | 403/322 |
| 5,597,283 | 1/1997 | Jones | 414/723 |

*Primary Examiner*—Donald W. Underwood
*Attorney, Agent, or Firm*—Delbert J. Barnard

[57] ABSTRACT

A first coupler component (12) is pivotally attached to a boom (14) for rotation about a first pivot axis (20) and is also pivotally attached to an actuation linkage (24) for pivotal movement about a second axis (22). A trunnion (26) surrounds and is concentric with the first pivot axis (20). A second coupler component (16) includes a notch (32) of a size and shape to engage the trunnion (26). The second coupler component (16) also includes an end portion (52) that is located above and is spaced from an end portion (54) on the first coupler component (12). A lock member (50) is received within a space between the end portions (52, 54). The lock member (50) is forceable into the space for spreading the end portions (52, 54) apart and forcing divergent side edges (34, 36) of the notch (32) into tight engagement with the trunnion (22). The second coupler component (16) is connected to a bucket (18) or other implement.

9 Claims, 4 Drawing Sheets

WEAR-COMPENSATING UNIVERSAL QUICK COUPLING DEVICE FOR HEAVY EQUIPMENT ATTACHMENT

TECHNICAL FIELD

This invention relates to a quick coupling device for attaching implements (e.g., a bucket) to a boom of a piece of heavy equipment. More particularly, the invention relates to a quick coupling device that permits interchangeability of implements between different pieces of equipment and that automatically compensates for wear at contact points between components.

BACKGROUND OF THE INVENTION

Heavy equipment units, such as backhoes and the like, have booms that may be detachably coupled to an implement (for example, a bucket, a rake or a grapple), which is carried by the boom to permit interchangeability of implements. Ordinary devices of this type may require several hours to complete an implement change. Attachment pins must be manually driven out of their pivotal sockets and then manually driven back into place for attachment of a different implement. Because of the size of the equipment involved, precise alignment is a challenge to achieve and adds to the difficulty of the job.

Many pieces of heavy equipment are outfitted with quick coupling devices so than an interchange of implements may be accomplished in a matter of minutes, rather than hours.

When heavy equipment, such as a backhoe, is designed, the junction between the implement, such as a bucket, and the boom (or stick), is carefully engineered. Ideally, the originally-designed axis of rotation between the implement and boom should be maintained. Some prior art quick coupling devices have failed in this regard in that this axis of rotation is undesirably shifted. In still other prior art devices, this axis of rotation is maintained, but as wear occurs at the engagement points, the point of coupling may become loose. In particular, this may be the case where lugs on the boom component of the coupling device fit between or within a spaced defined by lugs on the implement component of the coupling device.

Typically, each heavy equipment manufacturer will design a particular radial distance between the axis of rotation, at which the implement attaches to the boom, and the point of connection to the implement for rotational actuation. In the past, the components of the quick coupling devices had to be specifically designed to account for this variation. Consequently, implements built with a quick coupling component would only be interchangeable with other pieces of heavy equipment of the same class and manufacturer. Contractors or rental yards having more than one piece of heavy equipment made by different manufacturers would have to stock a separate and complete line of implements for each heavy equipment manufacturer.

U.S. Pat. No. 5,597,283 addresses this limitation. However, because the attachment lugs of the boom component fit between attachment lugs of the implement coupler component, there is a limit to the amount of wear compensation inherently available. That is, if the coupling device components are designed to be fully engaged when new, there is little or no room left for deeper or further engagement as wear occurs.

The following patents should be reviewed carefully for the purpose of putting the present invention into proper perspective: U.S. Pat. No. 3,556,323, issued Jan. 19, 1971, to Damian M. Heimmermann; U.S. Pat. No. 3,818,551, issued Jun. 25, 1974, to Samuel J. Coughran Jr.; U.S. Pat. No. 4,881,867, issued Nov. 21, 1989, to Stewart A. Essex et al.; U.S. Pat. No. 4,955,779, issued Sep. 11, 1990, to Jack S. Knackstedt; and U.S. Pat. No. 5,597,283, issued Jan. 28, 1997, to Gordon Jones.

SUMMARY OF THE INVENTION

The present invention relates to a quick coupling device for attaching a variety of implements to a boom of heavy equipment. The device includes a first coupler component, a corresponding second coupler component, and a lock member.

The first coupler component is pivotally attached to the boom about a first pivot axis and about which an implement and the first coupler component rotate relative to the boom. The first coupler component also is pivotally attached to an actuation linkage about a second pivot axis. The second pivot axis is radially spaced from and independent of the first pivot axis. The connection of the first coupler component and the actuation linkage rotationally pivots about the second pivot axis in order to provide rotational actuation of the implement about the first pivot axis.

On the first coupler component are at least one first coupling element in the form of a trunnion and at least one second coupling element. The is concentric with the first pivot axis. The second coupling element, which is independent of the second pivot axis, includes a substantially planar engagement surface.

The second coupler component is rigidly fixed to the implement. The second coupler component includes at least one first implement lug and at least one second implement lug corresponding to the first and second coupling element, respectively. The first implement lug includes a notch is of a size and shape to engage a corresponding first coupling element, i.e. trunnion on the first coupler component. The engagement of the first implement lug to its corresponding first coupling element provides rotational movement of the implement about the first pivot axis. The second implement lug is an arcuate contact surface for confronting and engaging a corresponding substantially planar second coupling element on the first coupler component. In use, the arcuate second implement lug is engaged with its corresponding substantially planar second coupling element such that surface engagement will remain intact and surface engagement will move tangentially on the arcuate surface as wear of either coupling element or implement lug occurs.

As discussed above, the present invention also includes a lock member to lock the first coupler component to the second coupler component without inhibiting rotational movement about the first and second pivot axis.

According to one embodiment, the first implement lug includes an outwardly-directed notch having two spaced-apart surfaces that are positioned to tangentially engage with said first coupling element. The notch is shaped to avoid contact with the trunnion in order to provide bottomless engagement with the trunnion.

According to another embodiment, the trunnion is annular in shape. In preferred form, there are two axially spaced-apart trunnions and two spaced-apart second coupling elements that correspond and engage with a pair of notches and planar surfaces, respectively.

According to another aspect of the invention, the first coupling element is concentric with the first pivot axis.

In yet another embodiment of the invention, each substantially planar engagement surface may also include a pair of oppositely-situated wings that extend upwardly and outwardly from the arcuate contact surface of the second implement lug. In this way, contact with the corresponding arcuate second implement lug is easily maintained.

As in the second or implement coupler, closure is designed to fit a variety of implement manufacturers, the second coupler component may further include a coupler flange that may be of a shape to fit a variety of implement buckets. The coupler flange is then rigidly attached to the implement.

In yet another embodiment, the quick coupling device of the present invention may also include markings indicating cut lines corresponding to a variety of implements in order to cut the second coupler component to closely confront a desired implement.

The present invention also includes a method of manufacturing a coupling device for quickly coupling a variety of implements to a boom of heavy equipment. The method further comprises the steps of first forming a first coupler component by providing a pair of spaced-apart plates and interconnecting the plates with at least one transverse member. Thus, an upwardly-facing opening of a size to receive the boom and an actuation linkage of the boom is formed. Next, first and second blanks are provided in at least one of the plates to align with a boom pivot pin of the boom and an actuation linkage pivot pin of the actuation linkage, respectively. The actuation linkage pivot pin is independent of but in the same plane as the boom pivot pin.

Next, the first blank is precision milled to form an opening through both plates in order to receive the boom pivot pin. This is done in order to pivotally attach the boom to the first coupler component about the boom pivot pin. Likewise, a second opening is precision milled through the second blank and through both plates to receive the actuation linkage pivot pin in order to pivotally attach the actuation linkage at the boom to the first coupler component about the actuation linkage pivot pin. Next, at least one coupling element is provided that is axially aligned with the first opening. The first coupling element is formed such that it projects from one of the plates and is of a size and shape to engage with a corresponding first implement lug.

Also, at least one second coupling element is provided by forming a substantially planar engagement surface that is laterally spaced from the first coupling element, but independent of the axis of which the actuation linkage pin rotates. The substantially planar engagement surface is formed to be a size and shape to engage a corresponding second implement lug.

The method also includes the step of providing a second coupler component to correspond with the first coupler component. The second coupler component is formed of spaced-apart implement plates of a size to rigidly confront and attach to an implement. At least one first implement lug is formed on the second coupler component such that the first implement lug corresponds to and engages with the first coupling element. At least one second arcuate contact surface implement lug on the second coupler component that is radially spaced from the first implement lug is formed. The second implement lug is formed to confront and engage the substantially planar surface of the second coupling element.

Last, the lock member is provided to lock the first coupler component to the second coupler component when the first coupler component is engaged with the second coupler component.

According to one aspect, the method also includes forming an oversized second blank to accommodate a variety of boom manufacturers. Likewise, the first blank may also be oversized to accommodate variations in boom manufacturers.

Advantages of the present invention include the ability to quickly couple various manufacturers' implements to various manufacturers' booms while still maintaining close coupling, even during wear over a period of time, and the ability to maintain the originally-designed axis of rotation between the boom and implement.

Further uses, benefits and features of the present invention will be seen from a review of the detailed description of preferred embodiments, the various figures of the drawing and the appended claims, all of which constitute part of the disclosure of the present application.

BRIEF DESCRIPTION OF THE DRAWINGS

Like reference numerals are used to denote like parts throughout the various figures of the drawing, wherein.

BEST MODE FOR CARRYING OUT THE INVENTION

Figure 1:
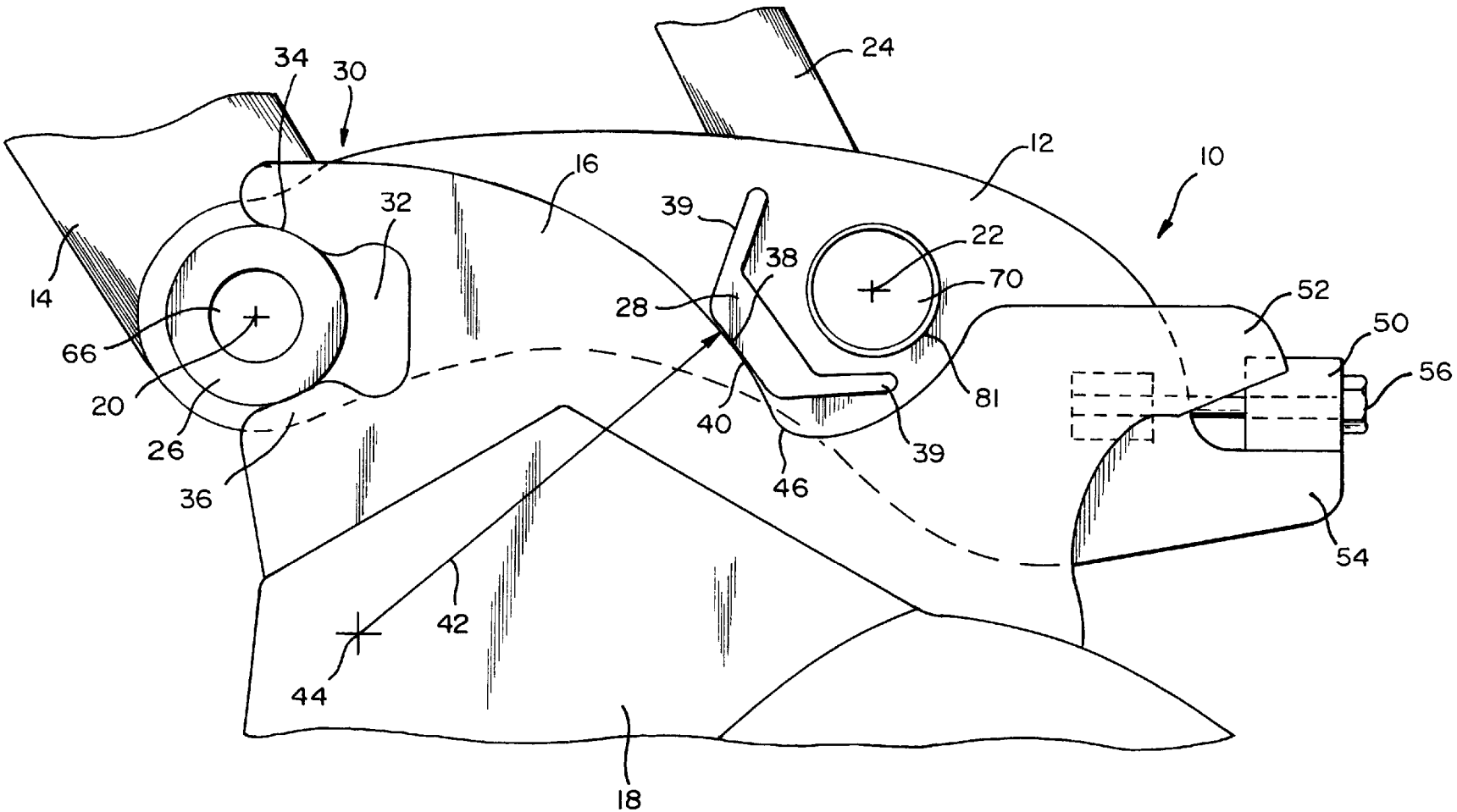
FIG. 1 is an enlarged side elevation view of a quick coupling device of the present invention in a coupled orientation.

Referring first to FIGS. 1–4 of the drawings, therein is shown at 10 a preferred embodiment of the quick coupling device, also called a coupler, of the present invention. Coupler 10 comprises a first coupler component 12 that is pivotally attached to a boom or stick 14 of a piece of heavy equipment (not shown). A second coupler component 16 of the coupler is fixed to the attached implement 18, in this case, a bucket. A first pivot axis 20 is defined about which the implement 18 and first coupler component 12 rotate relative to the stick 14. A second pivot axis 22 is defined at a point radially spaced from the first pivot axis 20, of which distance is determined by the choice of heavy equipment manufacturers discussed further below. The second pivot axis 22 is a point at which an actuation linkage 24 is attached to the first coupler component 12 for rotational actuation of the implement 18 about the first pivot axis 20.

Figure 5:
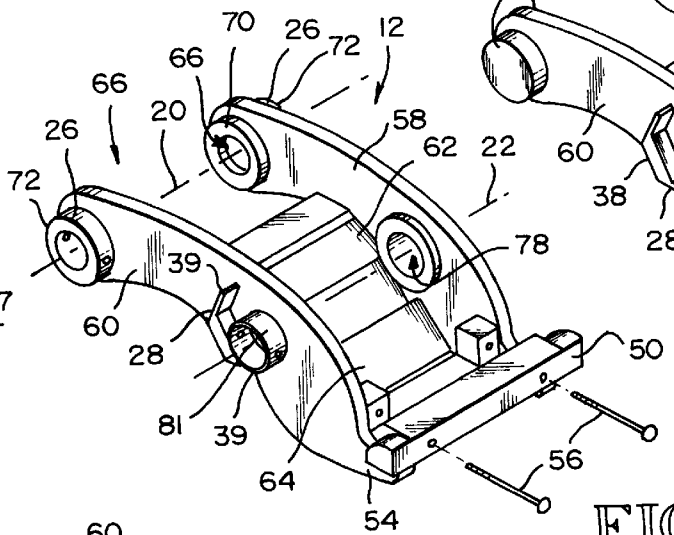
FIG. 5 is a pictorial view of a boom component of the quick coupler of the present invention.
Figure 8:
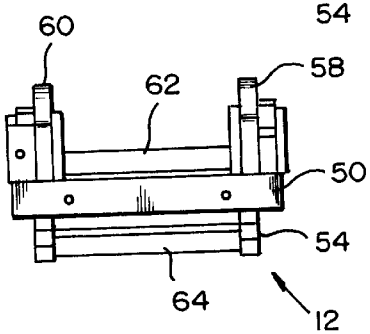
FIG. 8 is an end plan view of the component shown in FIG. 5.
Figure 6:
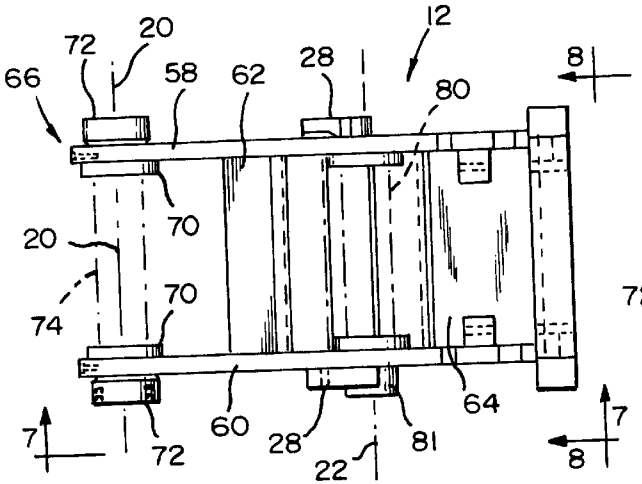
FIG. 6 is a top plan view of the component shown in FIG. 5.
Figure 7:
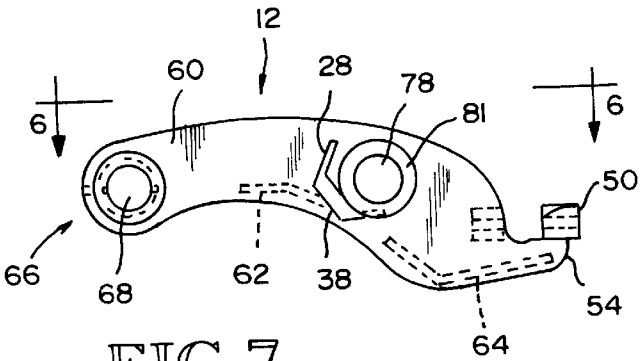
FIG. 7 is a side elevation view of the component shown in FIG. 5.
Figure 10:
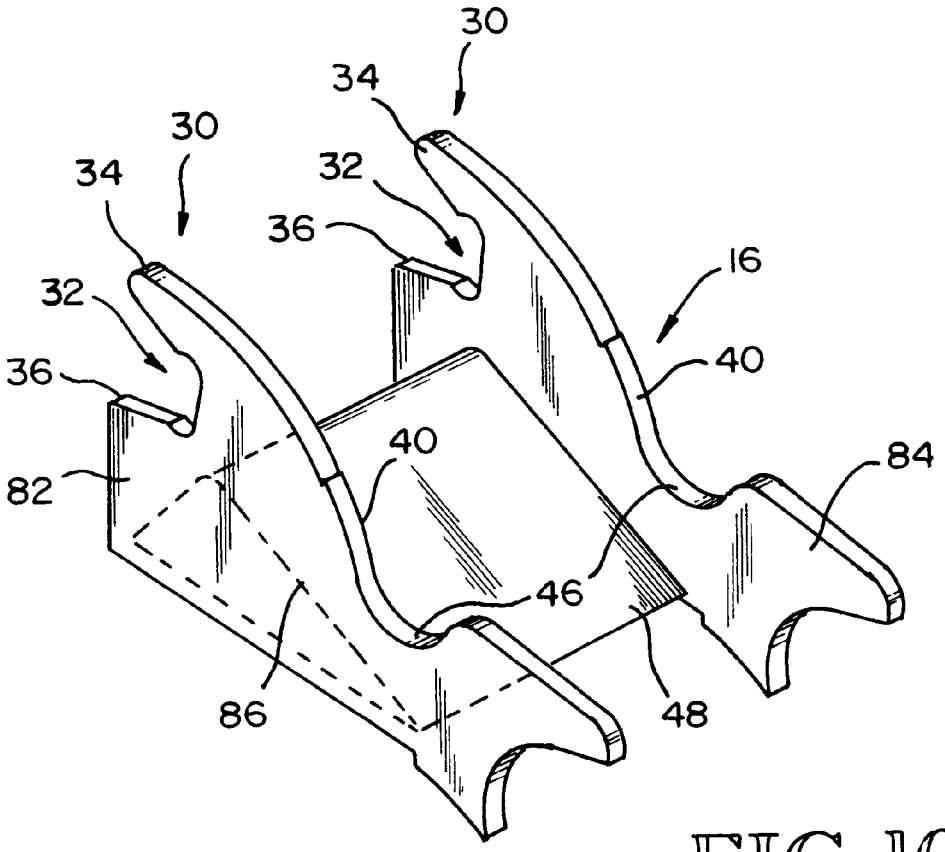
FIG. 10 is a pictorial view of the second coupler (bucket) component of the coupler and shown with coupling flanges to accommodate a variety of bucket manufacturings.

Referring also to FIG. 5, the first coupler component 12 includes a pair of spaced-apart coupling elements 26, 28 on each side of the first coupler component 12. The first coupling element 26 is in the form of a trunnion, which is concentric with the first pivot axis. In the drawings, trunnion 26 is shown concentric with pivot axis 20. In preferred form, trunnion 26 is an annular projection from each side of the first coupling element 12 (this can be best seen in FIG. 5). However, trunnion 26 may be axially offset from the first coupler component 12, as well.

Independent of second pivot axis 22, is second coupling element 28, which has a substantially planar engagement surface 38. Similar to the first coupling element 26, there are preferably two second coupling elements 28, one on each side of first coupler component 12 (refer to FIG. 5). Planar engagement surface 38 may include a pair of upwardly and outwardly extending wings 39 that bias planar surface 38 to maintain engagement with an arcuate contact surface on the second coupler component 16, discussed below. The wings also provide greater room for accommodating second pivot axis 22, which may be in a variety of locations generally central of the first coupler component 12. Although the "wing" shape is preferred, other shapes may be used, (e.g. a square).

Referring now to FIGS. 1–4 and 10 and 11, corresponding to the first coupling elements 26 (bosses) and the second coupling elements 28 (planar engagement surface 38) of the first coupler component 12, are two implement lugs 30, 38 positioned on the second coupler component 16.

Figure 11:
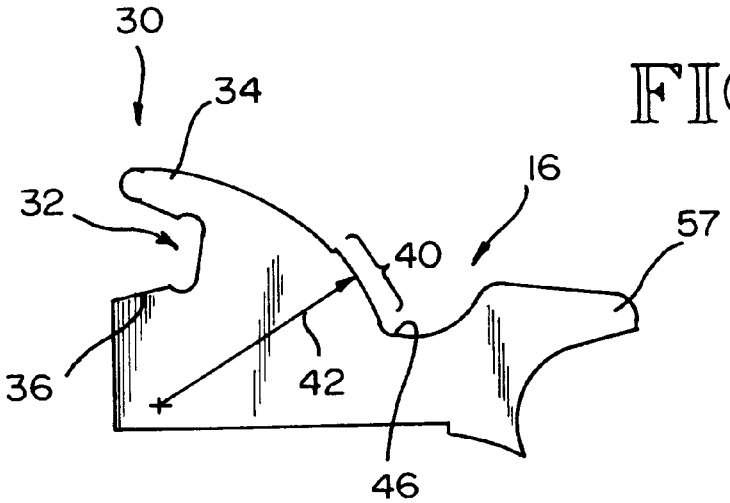
FIG. 11 is a side view of a blank of FIG. 10.

A first implement lug 30 is rigidly mounted on implement 18 and, in preferred form, comprises an outwardly-directed notch 32 positioned to engage with boss 26 of the first coupling element. According to one embodiment of the present invention, there are two spaced-apart implement lugs on each side of second component coupler 16. This is best seen in FIG. 11. Each open notch 32 is shaped to have two leg portions 34, 36 that tangentially engage a corresponding trunnion 26 of the first coupling component 12. The open portion between the two legs 34, 36 is shaped to avoid contact with trunnion 26, thereby providing a "bottomless" engagement of trunnion 26. The relative angular relationship between the inner surfaces of the leg portions 34, 36 provide for the trunnion 26 to be further engaged into notch 32 as wear occurs on either component without the trunnion 26 "bottoming" into notch 32.

A second implement lug 40 located on second coupler component 16 comprises an arcuate contact surface that is defined by a radius 42 from a point 44 offset from the first pivot axis 20. This arcuate contact surface 40 is situated to engage with the second coupling element 28, which is the substantially planar contact surface 38 of first coupler component 12. In this manner, the arcuate shape functions as a cam and presents a surface 40 that is progressively further from the first pivot axis 20 in the direction of which the coupler component 12 is moved toward the implement 18 during engagement. The radius 42 is sufficiently long such that as wear occurs to either the arcuate surface 40 or the substantially planar surface of the first coupler component 12, the second coupling element 28 (the planar surface) will not be able to be moved beyond the arcuate lug 40. Beyond the arcuate contact surface 40 in the direction of engagement, the implement (second coupler) component 16 is cut away at 46 (best shown in FIG. 1), such that the second engagement also will not "bottom out" as wear occurs.

The second coupler (or implement) component may be sized to fit a variety of implement manufacturers. To that end, coupling flanges 48 that conform to various implement manufacturers connect a pair of sides or plates 82, 84 of second component coupler 16. Template cut marks 85 conforming to various classes of manufacturers' implements may be added to plates 82, 84 in order to better conform plates 82, 84 to implement 18 (such close confinement shown in FIG. 1).

In prior art devices, a second coupling element took the form of a boss that was axially aligned with and surrounding the second pivot axis 22. In this manner, engagement between a second coupling element and a second implement lug was necessarily positioned according to the distance between the first and second pivotal axes 20, 22. Because this distance varies between manufacturers of heavy equipment, individualized coupler components were required to correspond with the dimensions of each manufacturer's equipment. It is an important aspect of the present invention that a second coupling element 28 on the first coupling component 12 is positioned independent of the second pivot axis 22. In this manner, as will be discussed in further detail below, standardized coupler parts, both those attached to the boom or stick and those attached to an implement, may be used with the exact position of the second pivot axis 22 being located anywhere between the ends of the first coupler component.

Figures 2, 3, 4:
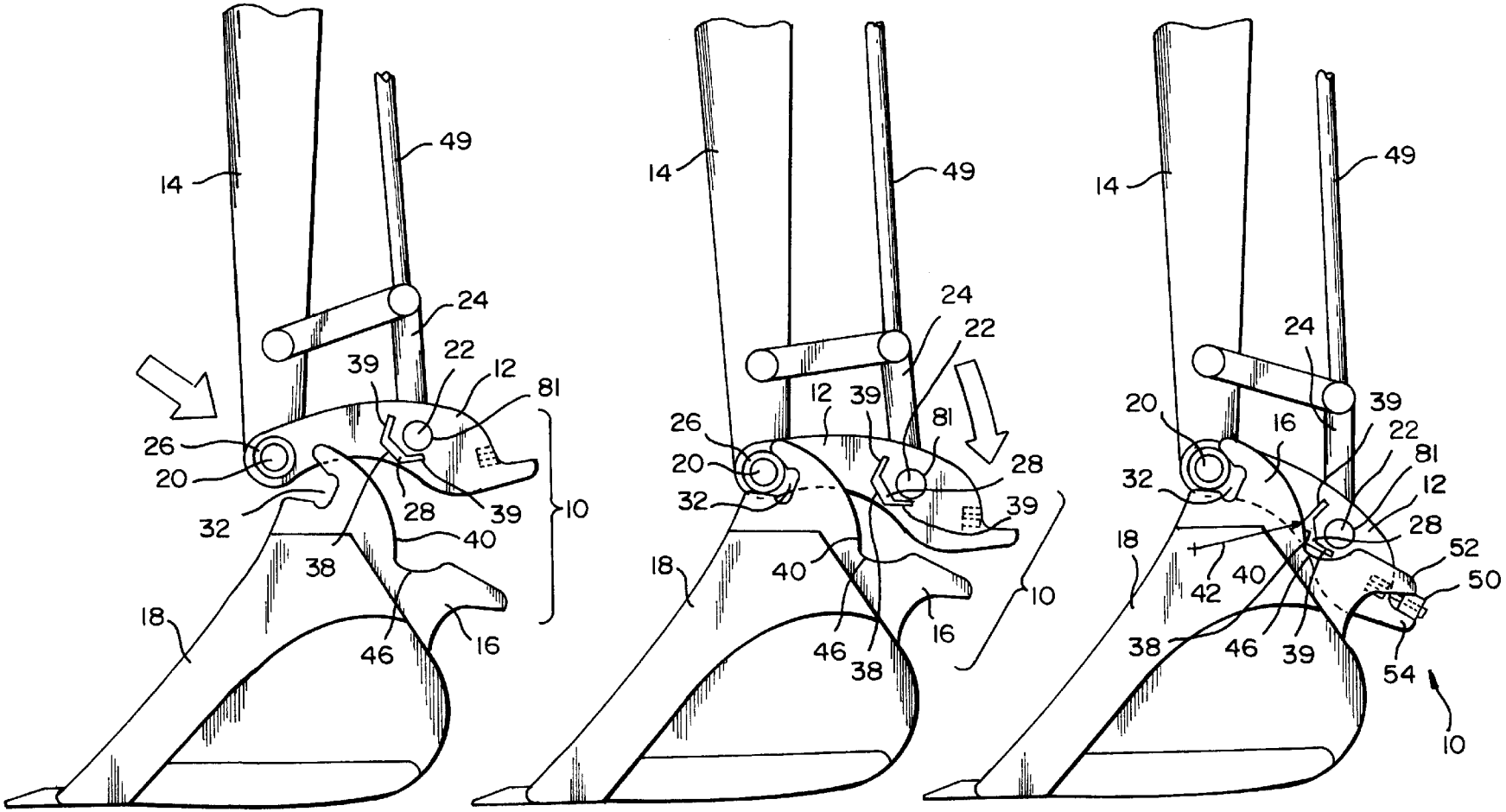
FIG. 2 is a side elevation view showing the distal end of a heavy equipment boom being moved into coupling position with a typical bucket, both having component parts of the quick coupling device of the present invention.
FIG. 3 is a view similar to FIG. 2 wherein the boom and bucket are partially coupled.
FIG. 4 is a view similar to FIGS. 2 and 3 wherein the boom and bucket are fully coupled and locked.

Referring now specifically to FIGS. 2–4, therein is shown a sequence of views in which the quick coupling device 10 of the present invention is engaged between the first coupler component 12 and the implement or second coupler component 16. In FIG. 2, the stick or boom 14 of the excavator or other heavy equipment (not shown) is moved in the direction of the arrow to cause trunnions 26 that are axially aligned with the first pivot axis 20 to move into engagement with their corresponding notches 32 of first implement lug 30. In the illustrated example, the implement is a bucket 18 in a typical position that it might be stored resting on the ground or a truck bed.

Referring to FIG. 3, after the trunnions 26 have been engaged into their corresponding notches 32, the first coupler component 12 is rotated by movement of an implement actuator 49, which move actuation linkage 24, such that the substantially planar surface 38 of the second coupling element 28 is moved into firm engagement with the second implement lug (arcuate contact surface) 40, which is located on the implement or second coupler component 16. This rotation, corresponding with the first pivot axis 20, is substantially as shown by the arrow in FIG. 3.

FIG. 4 shows the coupler components fully engaged and locked into place with a locking member 50, in order to lock implements 18 to boom 14. The lock member may be a locking bar, which is wedged between flanges 52, 54 on implement (or second coupler) component 16, and first coupler component 12 in order to prevent disengagement. Thus, implement 18 is locked to boom 14. This type of locking bar is well known to a person of ordinary skill in this field and may be moved into place either by threaded bolts 56 (also shown in FIG. 5) or by a hydraulic actuator (not shown). As is well known in the art, the positioning of the locking bar 50 is such that it does not bear or transfer primary loads of the coupler device 10 for either attaching or moving the implement 18. Instead, the locking bar 50 acts primarily to maintain the load-bearing engagements in place between the first and second implement lugs 30, 40 and the first and second coupler components 26, 28, respectively. Other locking means that are well known in the art may also be used.

Figure 9:
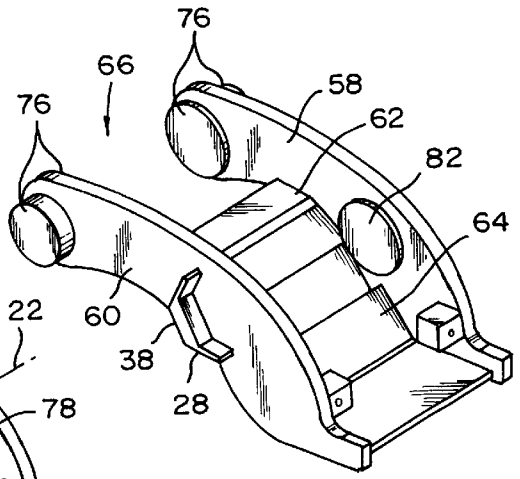
FIG. 9 is a pictorial view of a blank from which the boom coupling (first) component shown in FIG. 5 is made.

Referring now to FIGS. 5–9, therein is shown a preferred construction of the first coupler component 12 designed for pivotal attachment to the end of a stick or boom of a piece of heavy equipment. The first coupler component 12 includes a pair of laterally spaced-apart plates 58, 60 interconnected by transverse members 62, 64. At a first end 66, openings 68 reinforced by inner 70 and outer 72 bosses are formed for receiving a pivot pin 74 (shown in phantom in FIG. 5) corresponding with the first pivot axis 20. In preferred form, as shown in FIG. 9, reinforcement blanks 76 are attached, such as be welding, to the plates 58, 60, and then the openings 68 and engagement bosses 26 are precision milled therein.

Generally centrally located on plates 58, 60 are openings 78 for receiving a secondary or actuation pivot pin 80, which are formed according to specifications corresponding to that of the manufacturer of heavy equipment on which the first coupler component 12 is to be used. An externally projecting annular sleeve 81 may be added to plate 58 to aid in supporting pivot pin 80 relative to first coupler component 12.

Reinforcement blanks 82 (FIG. 9) may also be attached to the plates 58, 60, such as by welding, and then openings 78 corresponding to the second pivot axis 22 are formed therein, such as by precision milling. The exact placement of the openings can be varied by providing an oversized blank 82 and further varied by shifting the specific placement of the blank 82 prior to machining of an opening. For example, sleeve 81 (and pivot pin 80) appears to be closer to wings 39 in FIG. 7 than that of FIG. 1 as the location of the pivot pin will vary by manufacturing dictates. Because the second coupling elements 28 are positioned independent of the location of the secondary pivot axis 22 or pivot pin 80, the first coupler component 12, while being manufactured for equipment of an individual manufacturer, will universally couple with a wide variety of attachments or implements. Thus, various implements of various manufacturers can be quickly coupled through the device of the present invention to a variety of heavy equipment.

The second coupling elements 28 preferably are shaped to provide strength, rigidity and suitable welding area for attachment to the side plates 58, 60. Because the location of the second coupling elements 28 is independent of the second pivot axis 22, they can be consistently positioned such that engagement of the substantially planar surface 38 will confront the arcuate surface 40 of the second implement lug for any size or style of bucket or other attachment.

In preferred form, the coupler of the present invention is made of steel for strength and rigidity. Spaced-apart plates 58, 60 of the first coupler component 12 are made from 1 inch steel plate. Likewise, the sides of the second coupler component 16 are also made from 1" steel plate.

The preferred embodiment described above may be subject to modifications or reconfigurations without departing from the spirit and scope of the present invention. For this reason, our patent protection is not to be limited by or to the described preferred embodiment, but rather by the following claim or claims interpreted according to doctrines of claim interpretation, including the doctrine of equivalents and reversal of parts.

What is claimed is:

1. A quick coupling device for attaching implements to a boom, said device comprising:

a first coupler component adapted to be pivotally attached to the boom about a first pivot axis and about which an implement and said first coupler component rotate relative to the boom, said first coupler component also being adapted to be pivotally attached to an actuation linkage about a second pivot axis, which is radially spaced from and independent of the first pivot axis, wherein the connection of the first coupler component and the actuation linkage rotationally pivots about the second pivot axis in order to provide rotational actuation of the implement about the first pivot axis;

said first coupler component including at least one first coupling element and at least one second coupling element, wherein said first coupling element is a trunnion that is concentric with the first pivot axis, and wherein said second coupling element is independent of the second pivot axis and includes a substantially planar engagement surface;

a second coupler component adapted to be rigidly fixed to the implement;

said second coupler component including at least one notch of a size and shape to engage the trunnion on the first coupler component, wherein, in use, engagement of the notch and the trunnion provides rotational movement of the second coupler component and the implement about the first pivot axis;

said second coupler component also including at least one arcuate contact surface for confronting and engaging the substantially planar engagement surface on the first coupler component, wherein, in use, the arcuate surface on the second coupler component is engaged with the corresponding substantially planar engagement surface of the second coupling element, such that surface engagement will remain intact and surface engagement will move tangentially on the arcuate surface as wear of either the notch or the trunnion occurs;

a lock member adapted to lock the first coupler component to the second coupler component without inhibiting rotational movement about the first and second pivot axes;

wherein said notch includes two spaced-apart trunnion-contacting surfaces that are positioned to tangentially engage with said trunnion; and wherein said notch includes a base portion shaped to avoid contact with the trunnion in order to provide bottomless engagement of the notch with the trunnion.

2. The device of claim 1, wherein the trunnion is annular and includes a pivot pin receiving opening concentric with the first pivot axis.

3. The device of claim 1, wherein the first coupler component includes a side plate and a lateral projection on the side plate that includes the substantially planar engagement surface.

4. The device of claim 1, wherein the trunnion-contacting surfaces of the notch diverge apart as they extend away from the base of the notch and said surfaces extend tangentially of the trunnion where they contact the trunnion.

5. The device of claim 4, wherein the first coupler component includes an end portion opposite the trunnion, and the second coupler component concludes an end portion opposite the notch, and wherein the two end portions form a space between them in which the lock member is received, said end portions and said lock member being positioned such that movement of the lock member into the space and against the two end portions will force the planar engagement surface on the first coupler into contact with the arcuate contact surface on the second coupler component and will force the trunnion-contacting surfaces of the notch against the trunnion.

6. The device of claim 5, wherein one of the coupler components includes a threaded opening, and said lock member includes a bolt receiving opening, and a bolt having a threaded end and an opposite end, said bolt being insertable through the opening in the lock member, threaded end first, and said opposite end being adapted to bear against the lock member, whereby the bolt can be inserted through the opening in the lock member and threaded into the threaded opening, said two end portions of the two coupler components, said lock member, said threaded opening and said bolt being positioned such that when the bolt is tightened it will move the lock member into the space and into contact with the end portions of the coupler components.

7. A quick coupling device for connecting an implement to an implement handler, comprising:

a first component adapted to be connected to the implement handler, said first component having a pair of spaced apart side members and a pair of coaxial trunnions on the side members, said trunnions projecting laterally outwardly from the side members; and a second coupler component adapted to be connected to an implement, said second coupler component having a pair of laterally spaced apart side members that are positionable outwardly of the side members of the first coupler component, said side members of the second coupler component having notches that are positioned to receive the trunnions, each said notch having a base portion and a pair of trunnion engaging surfaces that diverge apart as they extend away from the base portion;

wherein said trunnion-contacting surfaces are positioned to tangentially engage said trunnions and when so engaged to maintain the base portion spaced from contact with the trunnions in order to provide bottomless engagement of the notches with the trunnions.

8. The device of claim 7, the side members of the coupler components include first end portions that include the trunnions and the notches and opposite second end portions which form a space between them, said space being adapted to receive a tapered lock member, and said end portions and said lock member being adapted such that movement of the lock member into the space and against the two second end portions will force the trunnion-contacting surfaces of the notches against the trunnions.

9. The device of claim 8, wherein one of the coupler components includes at least one threaded opening, and wherein at least one bolt extends through the lock member and threads into the threaded opening, and said second end portions of the coupler components, the lock member, the threaded opening and the bolt is adapted to cause the lock member to be moved into the space and against the second end portions of the side members of the coupler components in response to the bolt being tightened.

* * * * *